US007429148B2

(12) United States Patent
Verstraeten

(10) Patent No.: US 7,429,148 B2
(45) Date of Patent: Sep. 30, 2008

(54) METHOD FOR MAKING A FOUNDATION PILE

(75) Inventor: Alexander Julien Verstraeten, Belgie (NL)

(73) Assignee: Funderingstechnieken Verstraeten B.V., Oostburg (NL)

( * ) Notice: Subject to any disclaimer, the term of this patent is extended or adjusted under 35 U.S.C. 154(b) by 331 days.

(21) Appl. No.: 10/343,611

(22) PCT Filed: Aug. 2, 2002

(86) PCT No.: PCT/NL02/00527

§ 371 (c)(1),
(2), (4) Date: Jul. 24, 2003

(87) PCT Pub. No.: WO03/012211

PCT Pub. Date: Feb. 13, 2003

(65) Prior Publication Data

US 2004/0028480 A1 Feb. 12, 2004

(30) Foreign Application Priority Data

Aug. 3, 2001 (NL) ..... 1018702

(51) Int. Cl.
*E02D 5/34* (2006.01)

(52) U.S. Cl. ..... 405/240

(58) Field of Classification Search ..... 405/231–233, 405/235–238, 240–242, 244, 248–249, 252.1, 405/253–255, 257
See application file for complete search history.

(56) References Cited

U.S. PATENT DOCUMENTS

| | | | | |
|---|---|---|---|---|
| 2,146,645 | A * | 2/1939 | Newman | 405/239 |
| 3,636,718 | A | 1/1972 | Keats | 61/53.74 |
| 3,842,608 | A | 10/1974 | Turzillo | 61/53.52 |
| 4,009,582 | A * | 3/1977 | LeCorgne | 405/240 |
| 5,256,004 | A * | 10/1993 | Gemmi et al. | 405/237 |
| 5,423,636 | A * | 6/1995 | Mo | 405/266 |
| 5,934,836 | A | 8/1999 | Rupiper et al. | 405/244 |
| 6,394,704 | B1 * | 5/2002 | Saeki et al. | 405/252.1 |
| 6,402,432 | B1 * | 6/2002 | England et al. | 405/232 |

FOREIGN PATENT DOCUMENTS

| | | |
|---|---|---|
| EP | 0 228 138 | 7/1987 |
| EP | 0 539 630 | 5/1993 |
| FR | 1 528 811 | 6/1968 |
| JP | 07127055 | 9/1995 |

* cited by examiner

*Primary Examiner*—Sunil Singh
(74) *Attorney, Agent, or Firm*—Quarles & Brady LLP

(57) ABSTRACT

The invention relates to a method for arranging a foundation pile in the ground using a ground displacement drill, wherein a hollow drill pipe with a ground displacement drill attached thereto are jointly introduced as a foundation pile, with the aid of a pile cap coupled to the hollow drill pipe, into the ground under axial pressure, whilst rotating, and wherein during the introduction into the ground, via a liquid supply extending through the pile cap and the foundation pile, a liquid medium is supplied through the ground displacement drill to the ground, and wherein, after the foundation pile has been arranged sufficiently deep in the ground, the pile cap is thereupon uncoupled from the foundation pile and retracted from the ground, leaving the foundation pile behind, wherein during retraction of the pile cap, liquid is supplied via the pile cap to the space formed between the pile cap and the foundation pile. Further, the invention relates to a pile cap and a foundation pile which are used in the method according to the invention.

7 Claims, 4 Drawing Sheets

METHOD FOR MAKING A FOUNDATION PILE

Figure 1:
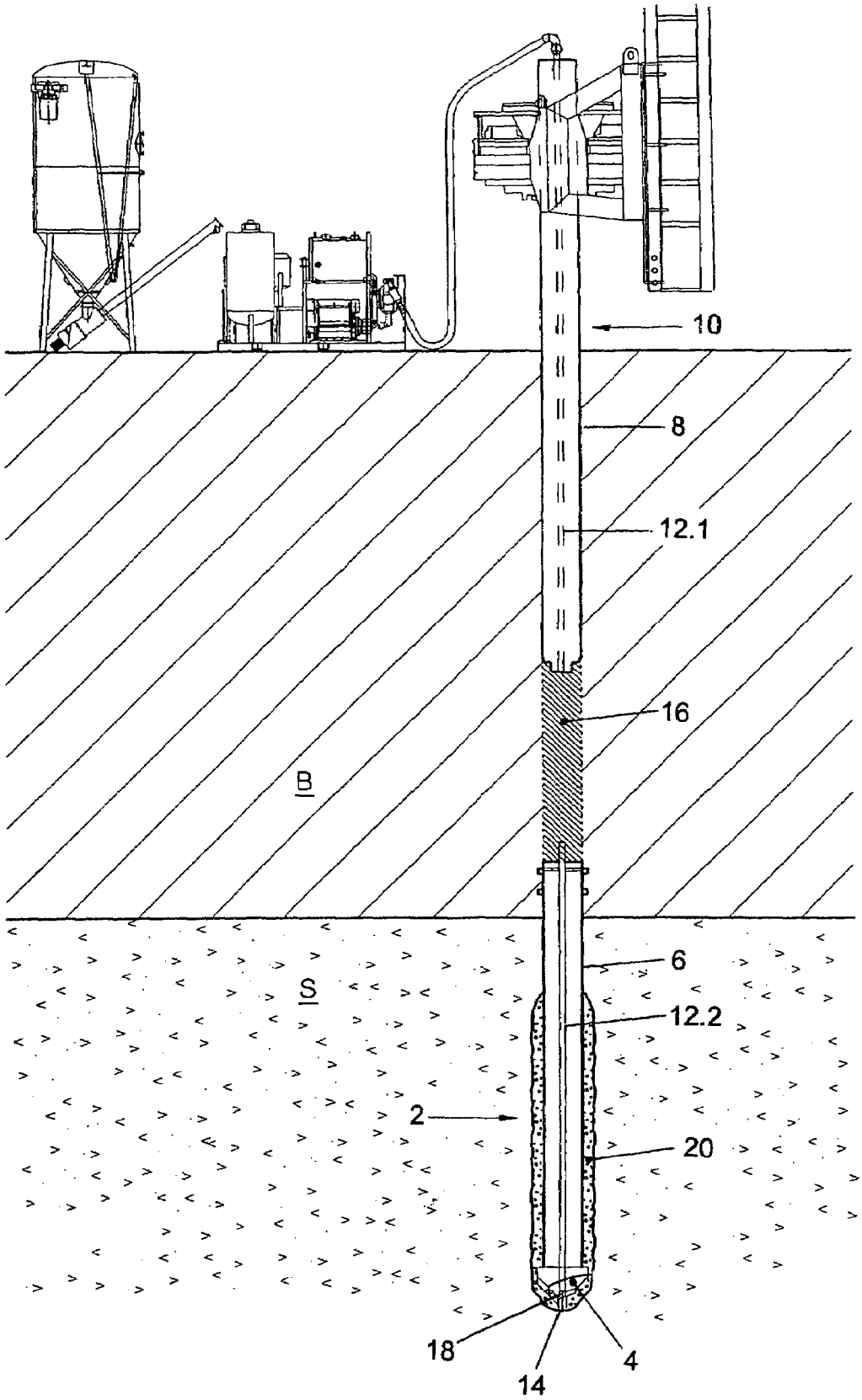

This invention relates to a method for arranging a foundation pile in the ground, wherein a hollow drill pipe with a ground displacement drill attached thereto are jointly introduced as a foundation pile, with the aid of a pile cap coupled to the hollow drill pipe, into the ground under axial pressure, whilst rotating, and wherein during the introduction into the ground, via a liquid supply extending through the pile cap and the foundation pile, a liquid medium is supplied through the ground displacement drill to the ground, and wherein, after the foundation pile has been arranged sufficiently deep in the ground, the pile cap is thereupon uncoupled from the foundation pile and retracted from the ground, leaving the foundation pile behind.

The invention further relates to a foundation pile.

The method referred to is based on the method according to NL 189365 and is known from practice. The method is typically employed in situations where pile driving is not possible, for instance because this entails too much nuisance. In such situations, a foundation pile is coupled to a pile cap and subsequently introduced into the ground under axial pressure whilst rotating. During the introduction of the foundation pile into the ground, via a liquid supply extending through the pile cap and foundation pile, a liquid medium is supplied through the ground displacement drill to the ground. In particular, a cement emulsion can be supplied to the ground through the tip of the ground displacement drill as soon as a supporting layer is reached. What is achieved by supplying the liquid medium referred to is that the rotation resistance of the foundation pile with respect to the ground is reduced. What can be further achieved by supplying the cement emulsion referred to into the supporting layer is that the foundation pile is eventually fixed under the ground level with additional firmness. After the foundation pile has been arranged sufficiently deep in the ground under ground level, the pile cap can subsequently be uncoupled from the foundation pile, and, whilst leaving the foundation pile behind, be pulled back through the top layer of ground situated above the supporting layer. According to this method, the upper ends of the foundation piles are arranged in the ground far below ground level, whereafter a top layer of ground situated above the supporting layer is subsequently removed for realizing a building pit or tunnel entrance. Often, the building pit or tunnel entrance is flooded after being excavated. In such a case, for instance an underwater concrete floor is poured, with the concrete floor being anchored to the foundation piles. After curing of the concrete floor, the building pit or tunnel entrance can be pumped dry. Depending on the specific construction of the building pit or tunnel entrance, the foundation piles thereupon take up a tensile load exerted by the water pressure on the underwater concrete floor. Naturally, if the building pit or entrance can remain dry, a concrete floor can be poured directly after excavation.

A disadvantage of the method mentioned is that as a result of the retraction of the pile cap from the ground, liquid flows are created in the ground in or near the foundation pile, so that disturbances in the soil structure adjacent the foundation pile may arise. In particular, there may arise disturbances in the mixing ratio of the cement emulsion referred to, so that the quality of the mixture diminishes. As a result, the bearing capacity of the foundation pile may be adversely affected. Further, the bearing capacity of the foundation layer itself may be affected. Furthermore, an undesirable liquid flow may be created via the ground displacement head through the supply line to the upper side of the foundation pile. This entails the possibility of the liquid flows carrying soil particles through the ground displacement head into the foundation pile.

The object of the invention is to provide a method of the type mentioned in the opening paragraph hereof, by which the disadvantages mentioned are prevented whilst maintaining the advantages thereof.

To that end, the method according to the invention is characterized in that during retraction of the pile cap, liquid is supplied via the pile cap to the space formed between the pile cap and the foundation pile. This prevents a reduced pressure arising between pile cap and foundation pile, so that undesirable liquid transport resulting from pressure differences is prevented.

In a further embodiment of the method according to the invention, during uncoupling, the liquid supply is divided into a first part extending through the pile cap and a second part extending through the foundation pile, and during retraction, liquid is supplied via the first part to the space formed between the pile cap and the foundation pile. In this method, during uncoupling of the foundation pile and the pile cap, the liquid supply is split into a first and a second part. As a consequence, it is possible during drilling to use the first part and the second part of the liquid supply for supplying the liquid medium to the ground, and during retraction to use the first part of the liquid supply for supplying the liquid medium to the space between the pile cap and the foundation pile for preventing the pressure differences mentioned during retraction of the pile cap.

In a further elaborated method according to the invention, after splitting of the liquid supply, the second part of the liquid supply, extending through the foundation pile, is closed off. This can be achieved, for instance, by including a non-return valve in the second part of the liquid supply. What can thus be prevented is the onset of a liquid flow from the drill tip via the second part of the supply line. What can further be achieved is that in a situation where during drilling the supply of the liquid medium through the liquid supply falters, soil particles are prevented from ending up via the ground displacement drill in the second part of the liquid supply. It is noted that such a ground displacement drill provided with a non-return valve may in itself already be used advantageously in drilling without a pile cap.

The invention further relates to a foundation pile for fixing engineering structures below ground level, comprising a hollow drill pipe carrying a ground displacement drill at a first end, which foundation pile is provided with a supply line extending from a second end of the drill pipe through the drill pipe and terminating at the outer surface of the ground displacement drill, which supply line is provided with a coupling piece adjacent the second end of the drill pipe.

Such a foundation pile is known from U.S. Pat. No. 3,842,608. U.S. Pat. No. 3,842,608 describes a foundation pile comprising a hollow pipe, having a ground displacement drill attached at one end. Through the pipe extends a liquid supply terminating in openings in the ground displacement drill.

This foundation pile is filled with cement and provided with a helical profile at its outer side. Provided between the windings of the profile are further openings in which the liquid supply terminates.

A drawback of the foundation pile according to U.S. Pat. No. 3,842,608 is that liquid may undesirably flow in from the drill tip via the supply line.

U.S. Pat. No. 3,636,718 describes a similar cement-filled foundation pile which is open at the top. With this foundation pile too, an undesirable liquid flow from the drill tip to the supply line can occur.

EP 0 228 138 describes a reusable, hollow drill pipe, through which during retraction cement can be injected into the drilled hole. To prevent an undesirable liquid flow, the hollow drill pipe may be provided at its underside with a non-return valve or with a drill head which functions as lid during drilling and upon retraction is left behind in the ground.

To prevent, during retraction of the pile cap, an undesirable liquid flow from the drill head through the supply line to the interspace formed, the foundation pile according to the invention is characterized in that the supply line is provided with a non-return valve.

Preferably, the non-return valve is arranged in or adjacent the ground displacement drill. In a situation where during drilling the pressure outside the ground displacement drill is higher than the pressure in the supply line, the non-return valve will close. As a result, soil particles can be prevented from penetrating into the supply line of the foundation pile.

The foundation pile can be coupled to a pile cap with the aid of the coupling piece. With the aid of the pile cap, a couple can subsequently be exerted on the foundation pile for drilling the foundation pile into the ground. The coupling piece is arranged such that the pile cap can exert a couple via the coupling piece on the foundation pile and that a liquid supply situated in the pile cap can be coupled substantially leakage-free to the supply line extending through the foundation pile.

In a further embodiment of the foundation pile according to the invention, the drill pipe is provided at a second end with a closing plate, and the coupling piece is designed as a length of pipe extending in axial direction of the drill pipe beyond the closing plate. The closing plate serves to prevent dirt and soil penetrating into the foundation pile after the foundation pile has been uncoupled from the pile cap in the soil under ground level. After the concrete floor has been poured in the building pit, and after the building pit, if required, has been rendered dry, the closing plate can be cut off from the foundation pile. Thereupon it is possible to fill up the foundation pile with, for instance, concrete and reinforcement steel. What is thus achieved is that the foundation pile does not need to be filled with cement during drilling.

The invention further relates to a pile cap and to a ground displacement drill for a foundation pile.

Further advantageous embodiments of the invention are described in the subclaims.

Figure 2:
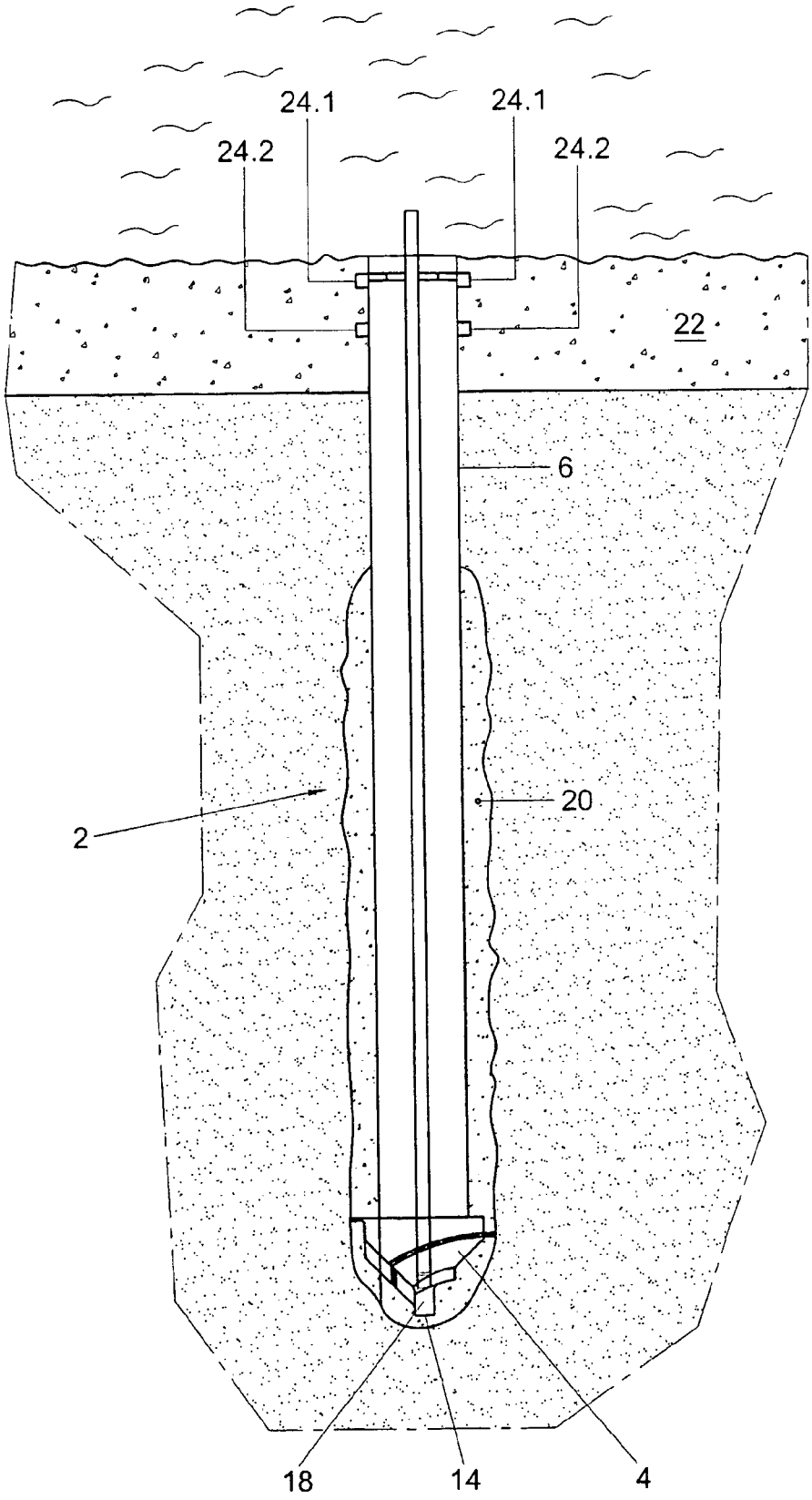
Figure 3:
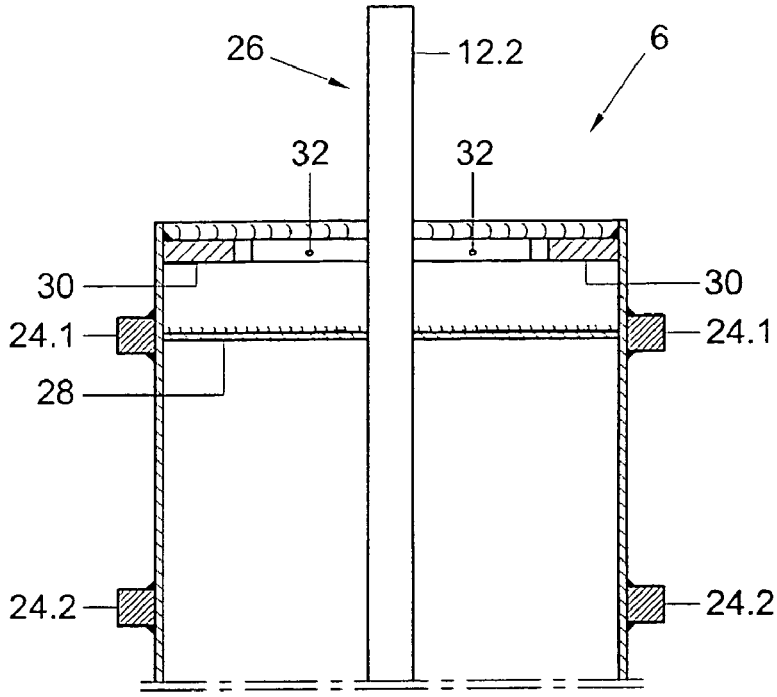
Figure 4:
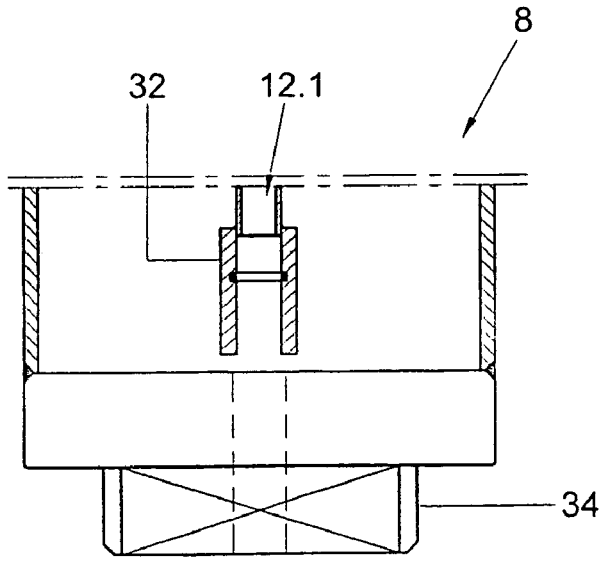
Figure 5:
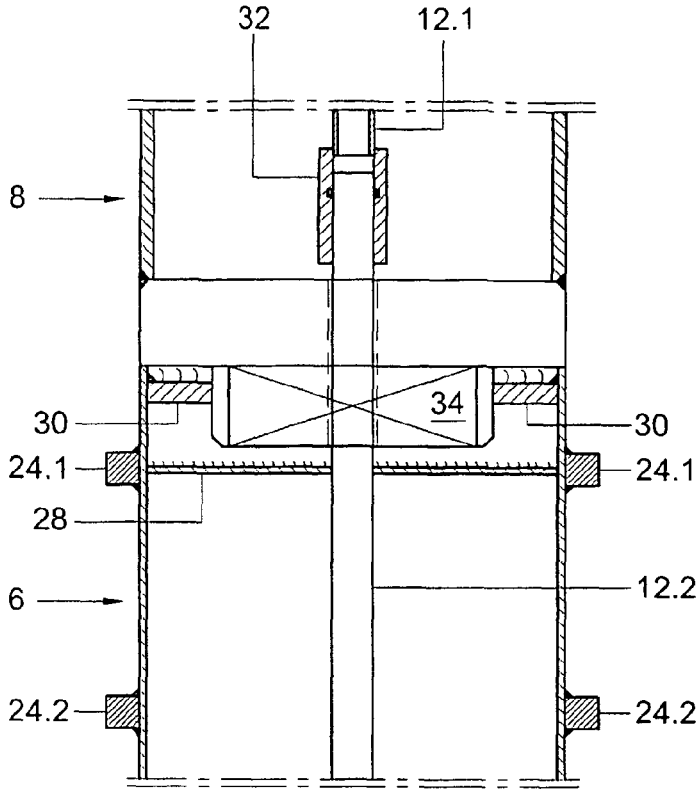
Figure 6:
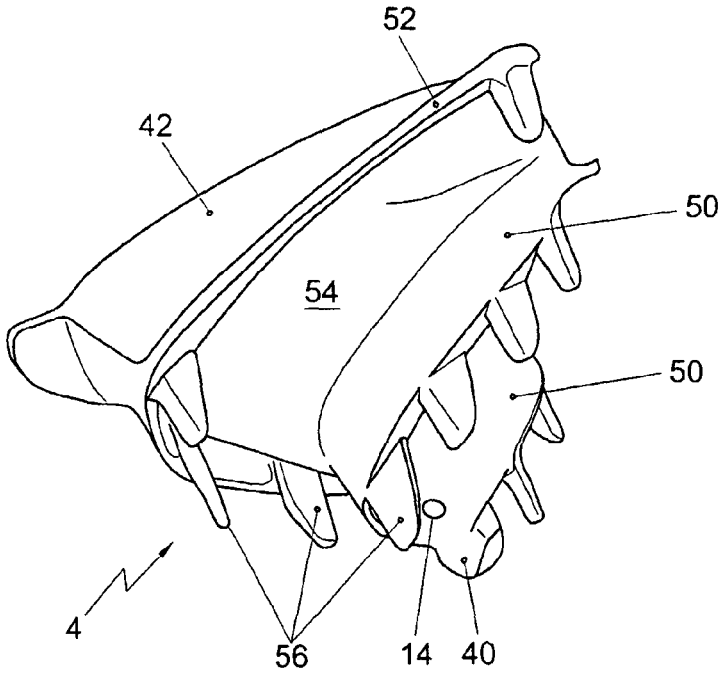

The invention will presently be further elucidated on the basis of an exemplary embodiment represented in a drawing. In the drawing:

FIG. 1 schematically shows a vertical cross section of a pile cap according to the invention and a foundation pile according to the invention arranged below ground level in a supporting layer situated below a top layer;

FIG. 2 schematically shows a vertical cross section of a foundation pile according to the invention arranged below ground level and anchored to an underwater concrete floor poured in a building pit;

FIG. 3 schematically shows in detail a longitudinal section of a second end of a foundation pile according to the invention;

FIG. 4 schematically shows a longitudinal section of a lower end of a pile cap according to the invention;

FIG. 5 schematically shows a longitudinal section of a pile cap according to the invention which is coupled to a foundation pile according to the invention;

FIG. 6 schematically shows a perspective view of a ground displacement drill according to the invention.

It is noted that the Figures are only examples of a preferred embodiment of the invention. In the Figures, identical or corresponding parts are indicated by the same reference numerals.

With the aid of the method according to the invention, foundation piles can be installed far below ground level for the purpose of fixing engineering structures. The piles can be used, for instance, for anchoring, through their upper ends, constructions on the bottom of building pits, such as a concrete floor for a tunnel entrance, which is poured under water in a building pit which has been excavated after installing the foundation piles.

In FIG. 1 the method according to the invention is further illustrated. In this Figure, a foundation pile 2 has been installed in the ground below ground level. The foundation pile 2 comprises a hollow drill pipe 6 to which the ground displacement drill 4 is attached. The hollow drill pipe 6 was detachably coupled to a pipe sleeve 8 of a pile cap 10 (see FIG. 5) for introducing the foundation pile 2 into the ground under axial pressure, whilst rotating. The cap 10 thereby exerted a torque on the foundation pile 2, so that the foundation pile 2 was rotated about its longitudinal axis, with the ground displacement drill 4 penetrating through a top layer B of the ground into a supporting layer S of the ground, situated below the top layer B. During drilling, via a liquid supply 12.1, 12.2 extending through the pile cap 10 and the foundation pile 2, a liquid medium was supplied through the ground displacement drill 4 to the ground. The liquid medium flowed through an opening 14 of the ground displacement drill 4. After the foundation pile 2 had been arranged sufficiently deep in the ground, the pile cap 10 was subsequently uncoupled from the foundation pile 2, whereupon the pile cap 10 could be retracted from the ground, leaving the foundation pile 2 behind in the ground. This is the situation achieved in FIG. 1.

During retraction of the pipe sleeve 8 of the pile cap 10, as represented in FIG. 1, a liquid medium is supplied via a first part 12.1 of the liquid supply 12.1, 12.2, to the space 16 formed between the pile cap 10 and the foundation pile 2, surrounded by the top layer B of the ground. This prevents significant pressure differences arising in the ground as a result of the retraction of the pile cap 10. What is thus achieved, for one thing, is that as few liquid flows as possible arise along or through the foundation pile 2, and what is further achieved is that the foundation pile 2 during retraction of the pile cap 10 is not sucked away from its position.

The foundation pile 2 includes a second part 12.2 of the liquid supply 12.1, 12.2. The second part 12.2 of the liquid supply can be closed off by a non-return valve 18 included in the second part 12.2. This non-return valve 18 in this example is included near the opening 14 of the foundation pile. In a situation where the foundation pile 2 is coupled to the pile cap 10 for drilling with the ground displacement drill 4, it may happen that the supply of a liquid medium via the liquid supply 12.1, 12.2 falters temporarily. As a consequence, the pressure in the second part 12.2 may be temporarily lower than the pressure in the soil adjacent the ground displacement drill 4. In this case, the non-return valve 18 closes, so that no liquid flows with soil particles can penetrate into the second part 12.2.

The liquid supply 12.1, 12.2 is sometimes referred to as grout line. During drilling, via the grout line, as indicated above, a liquid medium can be supplied to the soil via the opening 14. However, it is equally possible via the grout line to supply a cement emulsion 20 to the soil as soon as a sand layer is reached during drilling. With the cement emulsion 20, the foundation pile 2 can be fixed in the ground extra firmly.

FIG. 2 shows a foundation pile 2 arranged in the supporting layer S of the ground after the top layer of the ground B has been removed for forming a building pit and after an underwater concrete floor has been poured. The foundation pile 2 is anchored to a underwater concrete floor 22. For anchoring the concrete floor 22 with the foundation pile 2, the foundation pile 2 is provided with two flanges or rings 24.1 and 24.2. The cement emulsion 20 injected into the supporting layer S is clear to see in the Figure. This cement emulsion 20 is sometimes referred to as injected soil or mixed-in-place blend. In the Figure it is further shown that the second part 12.2 of the supply line 12.1, 12.2 projects by a certain length above the hollow drill pipe.

In FIG. 3, the second end of the drill pipe 6 is represented in more detail. The drill pipe 6 is provided at the upper end with a coupling piece 26. Adjacent the second end, the drill pipe 6 is further provided with a closing plate 28. The closing plate 28 serves to prevent dirt and soil penetrating into the foundation pile 2 when the foundation pile has been installed in the ground and the pile cap has been or is being retracted. The closing plate 28 extends substantially transversely with respect to the longitudinal axis of the foundation pile 2, engaging an inner wall of the foundation pile as well as the second part 12.2 of the supply line 12.1, 12.2. The closing plate 28 can be removed after curing of the concrete floor 22 and after the building pit has been pumped dry, so that the foundation pile 2 can be filled up with cement. In the example of FIG. 3, the coupling piece 26 is designed as a length of pipe reaching beyond the closing plate 28 in axial direction of the drill pipe 6.

The foundation pile 2 in FIG. 3 is provided with a moment absorbing plate 30 which is arranged between the second part 12.2 of the supply line 12.1, 12.2 and the inner wall of the foundation pile 2. The moment absorbing plate 30 extends substantially transversely to the longitudinal axis of the foundation pile 2 and is mounted on the inner wall of the foundation pile 2. The moment absorbing plate 30 is provided with a recess 32 which surrounds the second part 12.2 of the supply line. The moment absorbing plate 30 is situated at a smaller distance from the second end of the drill pipe 6 than the closing plate 28.

FIG. 4 shows a lower end of the pipe sleeve 8 of the pile cap 10. In FIG. 4, an arrow indicates where the first part 12.1 of the liquid supply 12.1, 12.2 terminates in a sleeve coupling 32. Through sliding in axial direction, this sleeve coupling 32 can be detachably coupled to the coupling piece 26 of the foundation pile 2. The sleeve coupling 32 is thereby slipped over the length of pipe of the foundation pile reaching beyond the closing plate. The sleeve coupling 32 can comprise a sealing, such as an O-ring, so that the first part 12.1 can be coupled at least substantially leakage-free to the second part 12.2 of the liquid supply. The hollow pipe sleeve 8 of the pile cap 10 further comprises a moment transfer projection 34 capable of cooperating with the recess 32 of the moment absorbing plate 30 of the hollow drill pipe 6 of the foundation pile 2.

In FIG. 5 it is shown that the hollow drill pipe 6 of the foundation pile 2 can be coupled to the pipe sleeve 8 of the pile cap 10. In the Figure, it can be seen that when this coupling is effected, the first part 12.1 of the liquid supply is coupled to the second part 12.2 of the liquid supply 12.1, 12.2. After the pile cap 10 has been coupled to the foundation pile 2 in the manner indicated in FIG. 5, drilling can take place. During drilling, the pile cap 10 transmits a couple to the foundation pile 2 via the moment absorbing projection 34 via the moment absorbing plate 30. During drilling, via the coupled parts of the liquid supply 12.1, 12.2, the liquid can subsequently be supplied to the ground through the foundation pile 2 via the ground displacement drill 4.

FIG. 6 represents a ground displacement drill 4 on a somewhat larger scale. The ground displacement drill 4 can be used as part of the foundation pile 2 according to the invention. The ground displacement drill 4 comprises a substantially cone-shaped drill head 54 which is provided with one or more openings 14 for supplying a liquid medium from the liquid supply 12.1, 12.2 to the soil. The openings 14 are preferably provided near the tip 40 of the drill in the outer surface of the drill tip, so that the liquid medium is chiefly supplied to the soil near the drill tip 40 of the ground displacement drill 4. The drill head is provided with coupling means not represented in the figure, for coupling to the liquid supply 12.1 and 12.2. Preferably, between the coupling means a length of pipe or bore is included which terminates in one or more openings 14 at the outer surface and in which a non-return valve is included. The drill head carries a substantially cylindrical edge 42 for cooperation with the end of the drill pipe 6.

In general, the inside diameter of the cylindrical edge 42 of the ground displacement drill 4 will be somewhat greater than the outside diameter of the drill pipe 6 of the foundation pile 2. Provided on the drill head 54 and/or the cylindrical edge 42 are cutting and displacement members, for instance designed as spirally configured ridges 50, 52. The ridges 50, 52 are provided with cutting teeth 56, which on the one hand facilitate drilling through relatively hard layers and on the other hand may be active as mixing members for the liquid medium supplied, such as grout, cement or the like, possibly with material of the drilled layers.

During drilling, ground particles are displaced in lateral direction by the parts 50 of the spiral ridges 50, 52. However, these particles can also move in upward direction along the drill head 54. This is certainly the case when the ground around the head 54 as a result of horizontal displacement is already so compacted that no further compaction in the horizontal direction is possible. These ground particles moving in upward direction along the rotating ground displacement drill 4 end up from the outer side of the part 50 of the spiral ridges 50, 52 on the upper side of the part 52 of these spiral ridges and are then forced in vertical direction by this part. The ground particles eventually end up in the place where the ground gives the least back pressure. Due to the portions 52 of the spiral ridges having a small pitch, they exert a great displacing force on the ground particles.

The invention has been described on the basis of a few preferred embodiments. However, the invention is not in any way limited to these embodiments. As will be clear to the skilled person, there are many other embodiments that also fall within the scope of the invention as set forth in the following claims.

The invention claimed is:

1. A method for arranging a foundation pile in the ground, wherein a hollow drill pipe with a ground displacement drill attached thereto are jointly introduced as a foundation pile, with the aid of a pile cap coupled to the hollow drill pipe, into the ground under axial pressure, whilst rotating, and wherein during the introduction into the ground, via a liquid supply line extending through the pile cap and the foundation pile, a liquid medium is supplied through the ground displacement drill to the ground, and wherein, after the entire foundation pile has been arranged sufficiently deep in the ground below ground level, the pile cap is thereupon uncoupled from the foundation pile and retracted from the ground, leaving the foundation pile behind, characterized in that during retraction of the pile cap, the liquid medium is supplied via the pile cap to the space below ground level formed between the pile cap and the foundation pile.

2. A method according to claim 1, wherein during uncoupling, the liquid supply line is divided into a first part extending through the pile cap and a second part extending through the foundation pile, and during retraction, the liquid medium is supplied via the first part.

3. A method according to claim 2, wherein the second part of the liquid supply line, extending through the foundation pile, is closed off.

4. A method for arranging a foundation pile in the ground, said method comprising:

coupling a pile cap to a foundation pile including a hollow drill pipe having a ground displacement drill attached thereto;

driving said foundation pile into the ground;

supplying a liquid medium through the ground displacement drill during the introduction of the foundation pile into the ground, via a liquid supply line extending through the pile cap and the foundation pile;

uncoupling the pile cap from the foundation pile after the foundation pile has been driven below ground level; and retracting the pile cap from the ground, wherein during retraction of the pile cap, the liquid medium is supplied via the pile cap to the space below ground level formed between the pile cap and the foundation pile.

5. The method according to claim 4, wherein the liquid supply line is divided into a first part extending through the pile cap and a second part extending through the foundation pile, and during retraction, the liquid medium is supplied via the first part to the space below ground level formed between the pile cap and the foundation pile.

6. The method according to claim 5, wherein the second part of the liquid supply line, extending through the foundation pile, is closed off.

7. The method as in claim 4, wherein, a portion of the liquid supply line is disconnected from the ground displacement drill during retraction of the pile cap.

* * * * *